US010837726B2

(12) United States Patent
Martinez

(10) Patent No.: US 10,837,726 B2
(45) Date of Patent: Nov. 17, 2020

(54) METHODS AND APPARATUS FOR SEALED TRIGGER HOUSING

(71) Applicant: Michael Martinez, Mesa, AZ (US)

(72) Inventor: Michael Martinez, Mesa, AZ (US)

( * ) Notice: Subject to any disclaimer, the term of this patent is extended or adjusted under 35 U.S.C. 154(b) by 0 days.

(21) Appl. No.: 16/575,288

(22) Filed: Sep. 18, 2019

(65) Prior Publication Data

US 2020/0088485 A1 Mar. 19, 2020

Related U.S. Application Data

(60) Provisional application No. 62/732,717, filed on Sep. 18, 2018.

(51) Int. Cl.
*F41A 19/10* (2006.01)

(52) U.S. Cl.
CPC ..... *F41A 19/10* (2013.01)

(58) Field of Classification Search
CPC ..... F41A 19/10; F41A 19/11; F41A 19/14
See application file for complete search history.

(56) References Cited

U.S. PATENT DOCUMENTS

| | | | | |
|---|---|---|---|---|
| 7,293,385 | B2 * | 11/2007 | McCormick | F41A 19/10 42/75.03 |
| 7,587,851 | B1 * | 9/2009 | Luth | F41A 19/00 124/31 |
| 10,401,107 | B2 | 9/2019 | Martinez | |
| 2011/0173859 | A1 * | 7/2011 | Findlay | F41A 19/11 42/69.01 |
| 2017/0191776 | A1 * | 7/2017 | Dextraze | F41A 19/12 |
| 2018/0003457 | A1 * | 1/2018 | McCallum | F41A 19/10 |

OTHER PUBLICATIONS

SLT-1 Trigger. <https://forums.brianenos.com/topic/248403-new-slt-1-trigger/>. Apr. 30, 2017. (Year: 2017).*

* cited by examiner

*Primary Examiner* — Gabriel J. Klein
(74) *Attorney, Agent, or Firm* — The Noblitt Group, PLLC

(57) ABSTRACT

A sealed trigger housing according to various aspects of the present technology is configured to provide a more effective method of preventing foreign debris from entering the trigger housing. Various embodiments of the sealed trigger housing comprise a pair of side plates configured to at least partially house a trigger, a hammer, and a selector switch within an interior portion of the trigger housing. A plurality of sealing elements may be used to create a seal around any component that protrudes outwardly from the trigger housing.

11 Claims, 5 Drawing Sheets

METHODS AND APPARATUS FOR SEALED TRIGGER HOUSING

CROSS-REFERENCES TO RELATED APPLICATIONS

This application claims the benefit of U.S. Provisional Patent Application No. 62/732,717, filed Sep. 18, 2018, and incorporates the disclosure by reference. To the extent that the present disclosure conflicts with any referenced application, however, the present disclosure is to be given priority.

BACKGROUND OF THE TECHNOLOGY

Trigger mechanisms of firearms include multiple working components such as a sear, hammer, trigger, springs, and pins that are commonly positioned within a trigger housing. The working components are configured to move in relation to each other to allow the firearm to properly fire the round of the firearm. Although trigger housings enclose the working components the housing is not typically sealed to prevent foreign debris from getting into the interior of the trigger housing.

Components that protrude outwardly from the trigger housing are components that generally rotate or pivot during operation. Similarly, components positioned completely within the trigger housing are configured to move, pivot, compress, and/or lock in place during normal operation of the firearm. If debris such as sand, dust, or other like small particulate matter gets into the trigger housing the moving parts may be prevented from moving properly causing the firearm to malfunction. Certain types of malfunctions require that the entire trigger assembly of the firearm be disassembled and cleaned before the firearm will function properly again.

SUMMARY OF THE TECHNOLOGY

A sealed trigger housing according to various aspects of the present technology is configured to provide a more effective method of preventing foreign debris from entering the trigger housing. Various embodiments of the sealed trigger housing comprise a pair of side plates configured to at least partially house a trigger, a hammer, and a selector switch within an interior portion of the trigger housing. A plurality of seals may be used to create seals around any component that protrudes outwardly from the trigger housing.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

Figure 1:
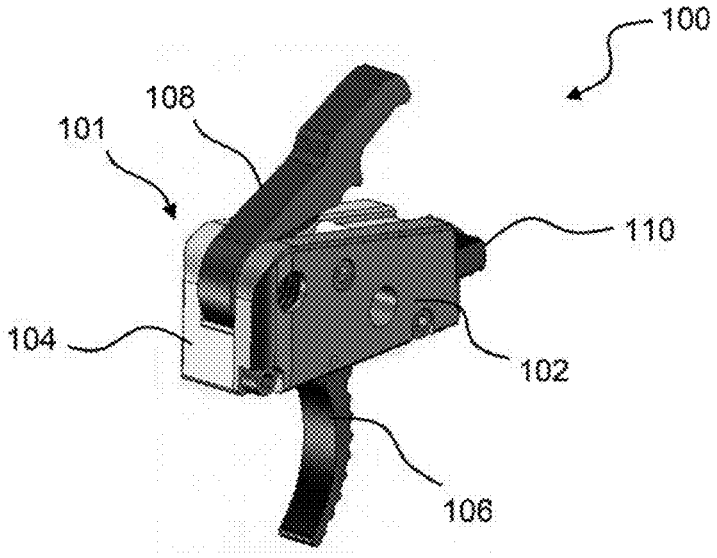
FIG. 1 representatively illustrates a front perspective view of a sealed trigger housing in accordance with an exemplary embodiment of the present technology.
Figure 2:
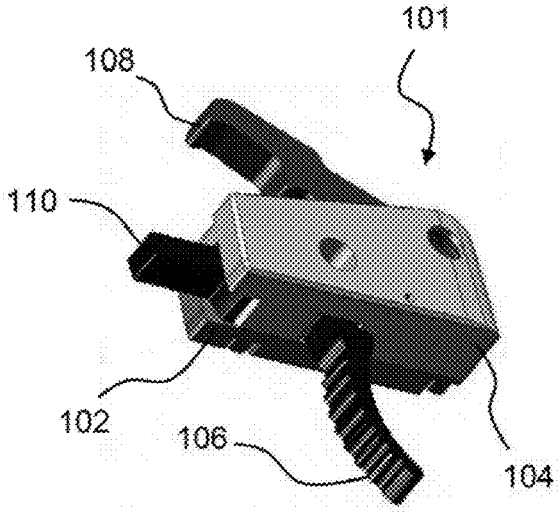
FIG. 2 representatively illustrates a bottom rear perspective view of the sealed trigger housing in accordance with an exemplary embodiment of the present technology.
Figure 3:
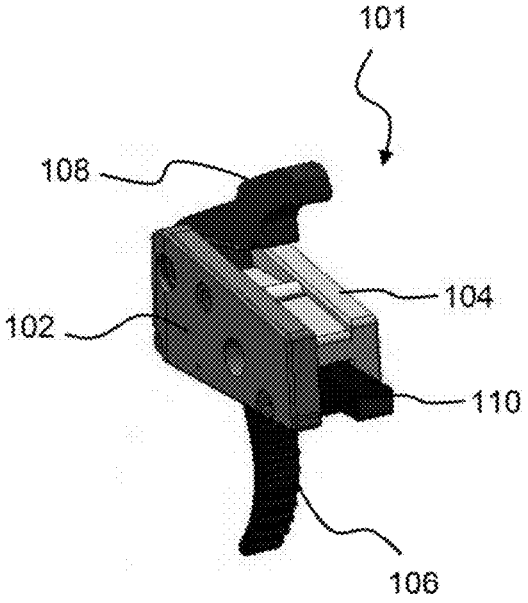
FIG. 3 representatively illustrates a rear top perspective view of the sealed trigger housing in accordance with an exemplary embodiment of the present technology.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various materials, finishes, dimensions, and geometries, which may carry out a variety of operations suited to a specified application or environment. In addition, the present technology may be practiced in conjunction with any number of systems configured for operation with firearms, and the system described is merely one exemplary application for the technology. Further, the present technology may employ any number of conventional techniques for sealing, preventing intrusion of foreign object debris, and the like.

Methods and apparatus for a sealed trigger housing according to various aspects of the present technology may operate in conjunction with any type of semi-automatic or automatic firearm. Various representative implementations of the present technology may be applied to any type of firearm including a hand gun or rifle and may be retrofit into various types of existing firearms. For example, the sealed trigger housing may be used as a "drop in" replacement for a trigger originally installed on a firearm.

Referring to FIGS. 1-3 and 7, a sealed trigger housing 100 may generally comprise a trigger housing 101 comprising a first housing plate 102 and a second housing plate 104. The trigger housing 101 is configured to at least partially house one or more trigger mechanism components such as a trigger 106, a hammer 108, and a selector switch 110 within an interior volume of the trigger housing 101. The trigger housing 101 may also fully enclose additional working components or moving parts such as springs, pins, a sear link, and a main sear that functionally link the trigger 106 to the hammer 108 and the selector switch 110.

The trigger 106 is used to selectively release the hammer 108 from a first position allowing it to rotate and strike a projectile causing the projectile to be fired from the firearm. The trigger 106 may comprise any suitable device or system for activating the hammer 108. At least one surface of the trigger 106 may be configured to at least partially conform to a portion of a user's finger and be configured to rotate about a pivot point within the trigger housing 101 in response to a pressure force being applied to the trigger 106 by the user's finger.

The hammer 108 rotates from a first position to strike a firing pin (not shown) on the ammunition round (not shown). Upon firing of the round, recoil forces are used to return the hammer 108 to the first position. The hammer 108 may comprise any suitable device or system for causing the round to be fired in response to a force being applied to the trigger 106. The hammer 108 may comprise a body having a first end portion with a surface configured to contact a firing pin of the ammunition round and a second end portion having a hole therethrough about which the hammer 108 rotates. For example, the hammer 108 may be coupled to the trigger 106 by a pin or sleeve configured to extend from a first side of the trigger housing 101, through the hole, and to a second side of the trigger housing 101. The hammer 108 may then rotate about the hole and the second sleeve during the actuation cycle.

Figure 4:
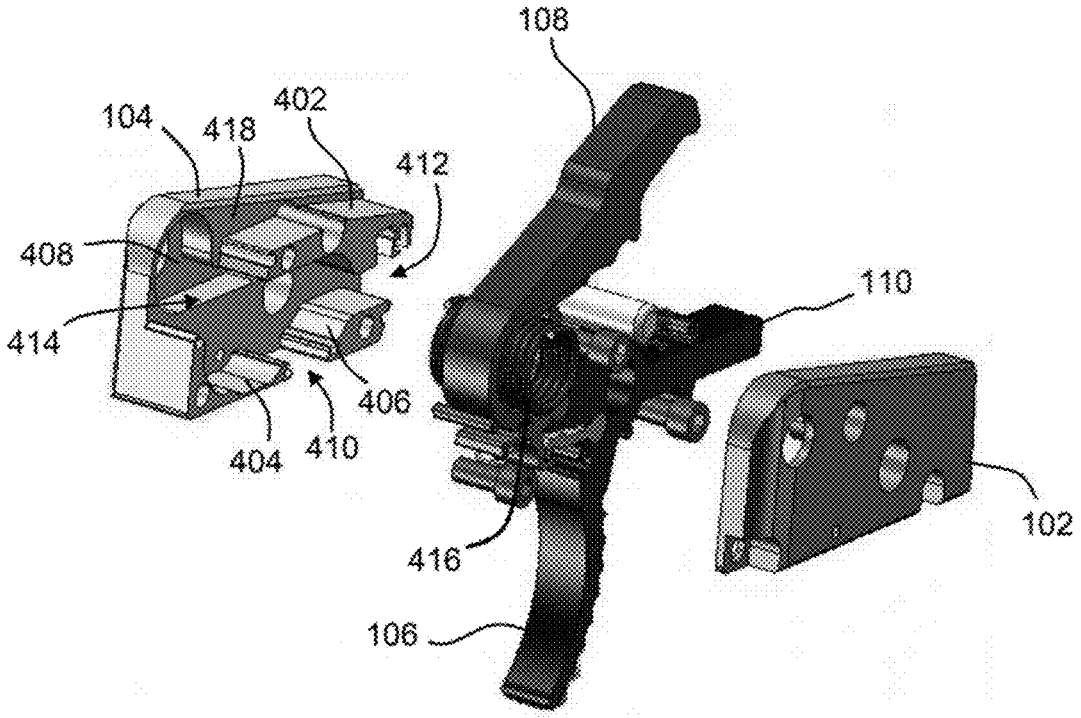
FIG. 4 representatively illustrates an exploded view of the sealed trigger housing in accordance with an exemplary embodiment of the present technology.
Figure 5:
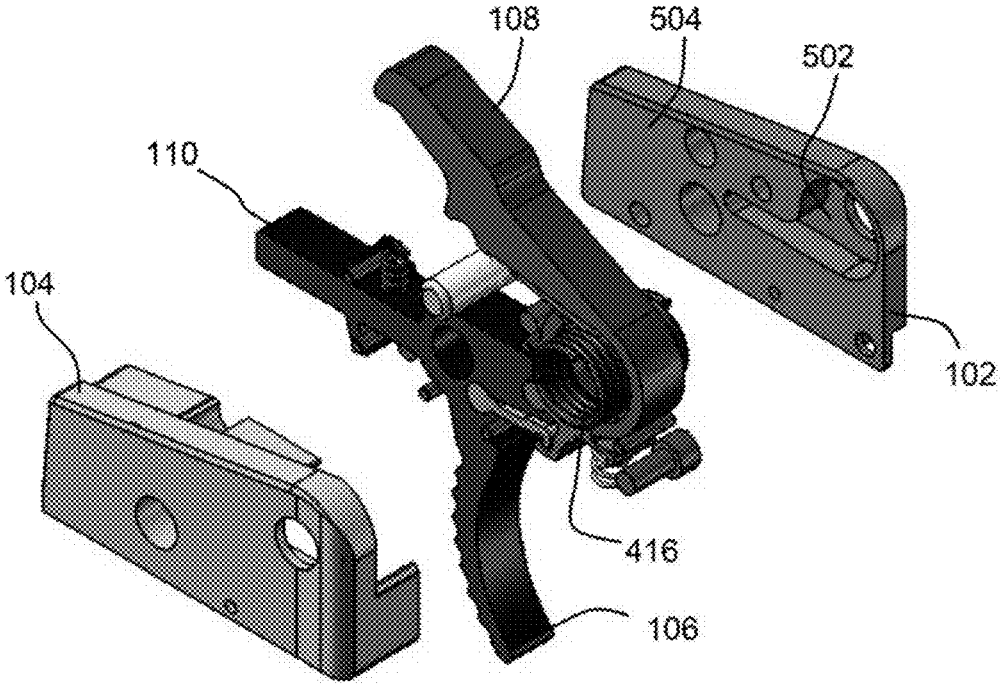
FIG. 5 representatively illustrates an exploded view of the sealed trigger housing in accordance with an exemplary embodiment of the present technology.
Figure 6:
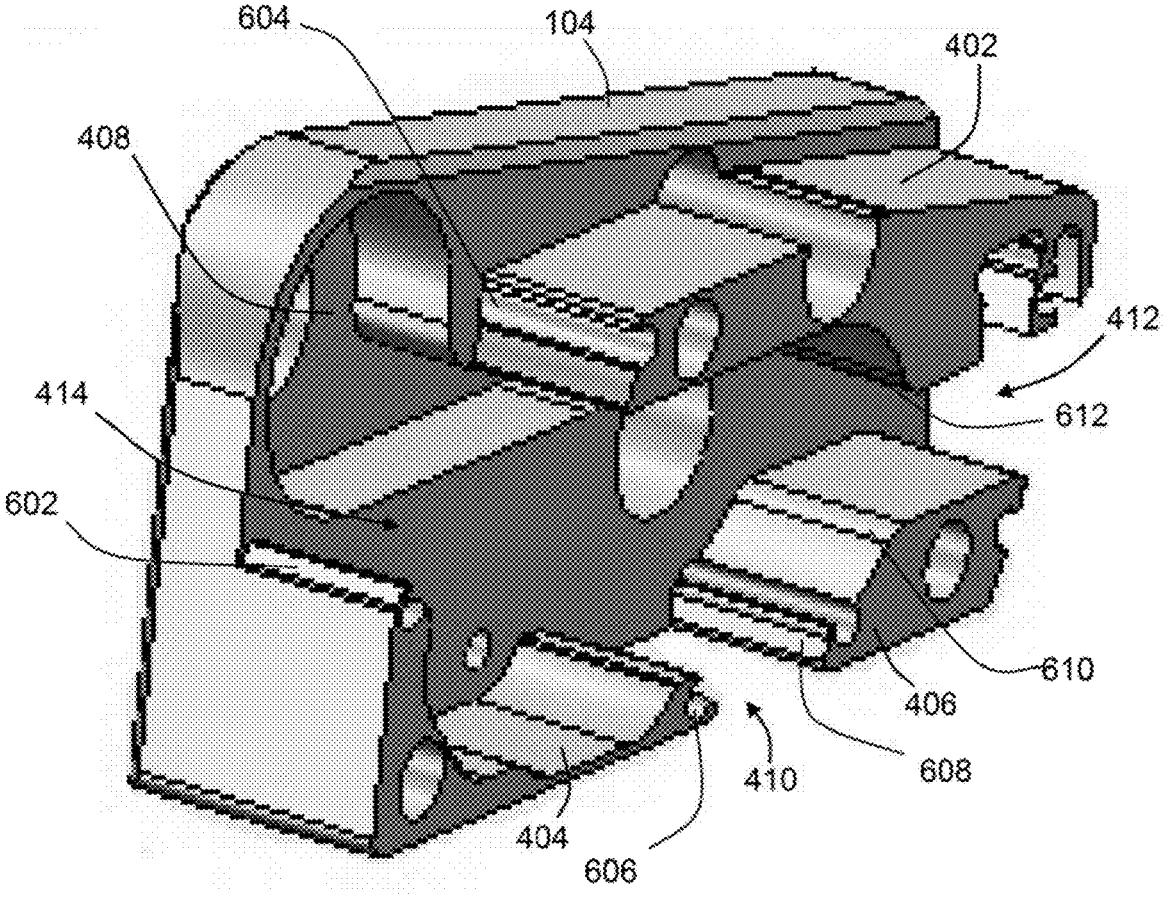
FIG. 6 representatively illustrates a detailed view of a housing plate in accordance with an exemplary embodiment of the present technology.
Figure 7:
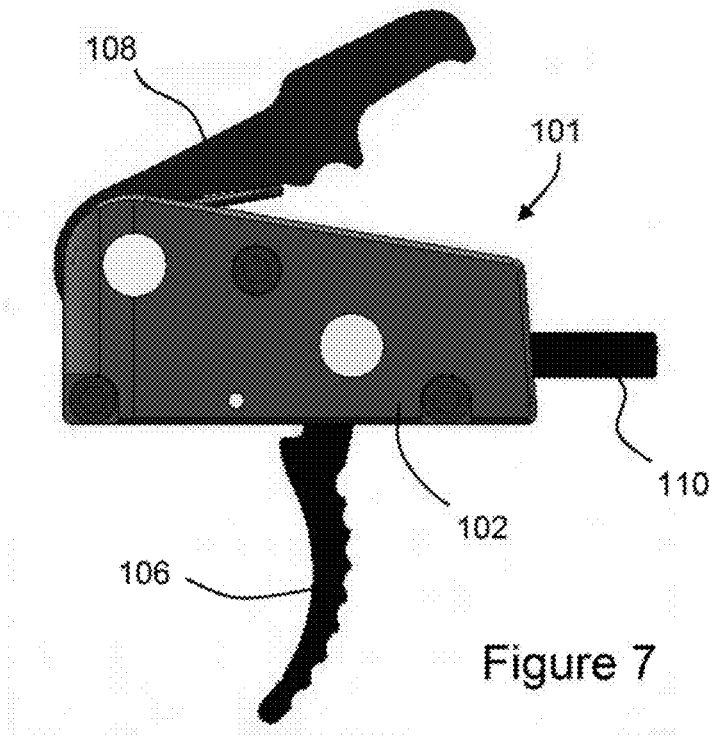
FIG. 7 representatively illustrates a side view of the sealed trigger housing in accordance with an exemplary embodiment of the present technology.

Referring now to FIGS. 4-6, to prevent the intrusion of foreign debris into the trigger housing 101, the first housing plate 102 and the second housing plate 104 are configured to form a seal when coupled together. Unlike prior art trigger housings, which leave the interior portion open to the environment, the trigger housing 101 of the present technology seals off interior components within the interior portion of the trigger housing 101. For example, the first housing plate 102 may comprise a first recess 502 and the second housing plate 104 may comprise a second recesses 408 configured to receive, conform to, or otherwise fit around one or more trigger mechanism components. For example, the first recess 502 may be configured to receive a first side of a hammer spring 416 and the second recess 408 may be configured to receive an opposing second side of the hammer spring 416.

The first housing plate 102 and the second housing plate 104 may abut each other when coupled together such that the interior of the trigger housing 101 is at least partially closed off from the exterior environment. The first housing plate 102 and the second housing plate 104 may be configured in any suitable manner to create a seal. In one embodiment, an interior facing surface 504 of the first housing plate 102 may fit flush against one or more interior facing surfaces of the second housing plate 104 to seal the trigger housing 101.

For example, the second housing plate 104 may comprise an upper cover portion 402, a lower trigger portion 406, and a lower spring portion 404 that extend outward from an interior facing surface 418 of the second housing plate 104. The interior facing surface 504 of the first housing plate 102 may be configured to abut against the upper cover portion 402, lower trigger portion 406, and lower spring portion 404 of the second housing plate 104 to effectively form a seal between the surfaces when connected together.

Several components extend outward from the interior of the trigger housing 101 requiring the presence of one or more openings between the first and second housing plates 102, 104. For example, in one embodiment, the trigger housing 101 may comprise a trigger opening 410 disposed between the lower trigger portion 406 and the lower spring portion 404 of the second housing plate 104 and a hammer opening 414 may be positioned between the upper cover portion 402 and the lower spring portion 404 of the second housing plate 104. In some embodiments, the trigger housing 101 may further comprise a selector opening 412 disposed between the upper cover portion 402 and the lower trigger portion 406 of the second housing plate 104. Additional openings may be required according to a particular trigger assembly.

Figure 9:
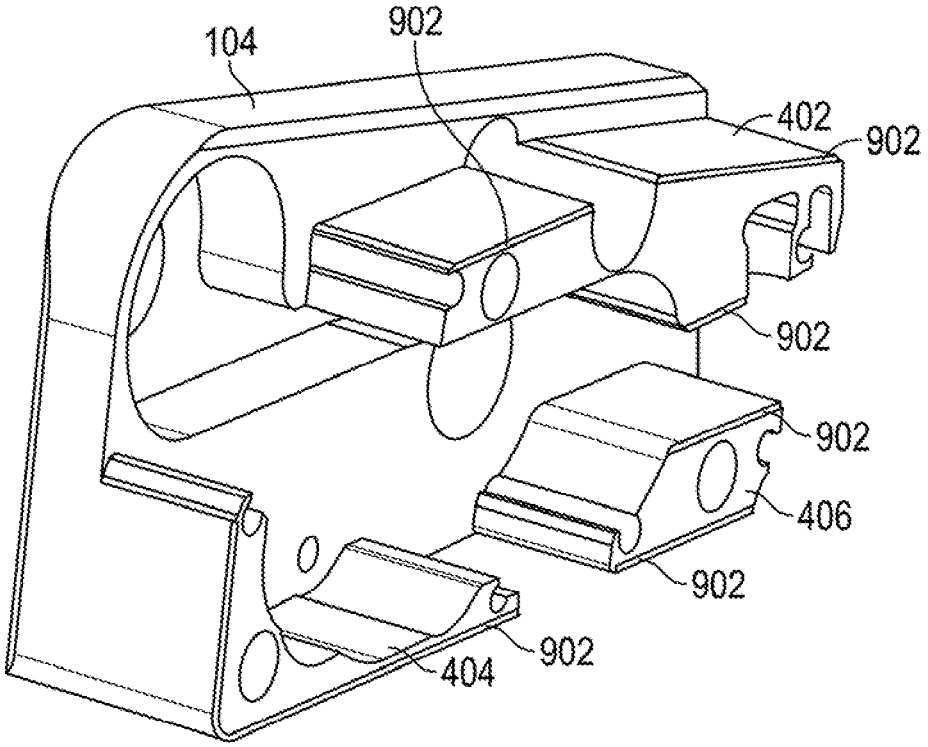
FIG. 9 representatively illustrates a perspective view of an alternative embodiment of a housing plate in accordance with an exemplary embodiment of the present technology.
Figure 10:
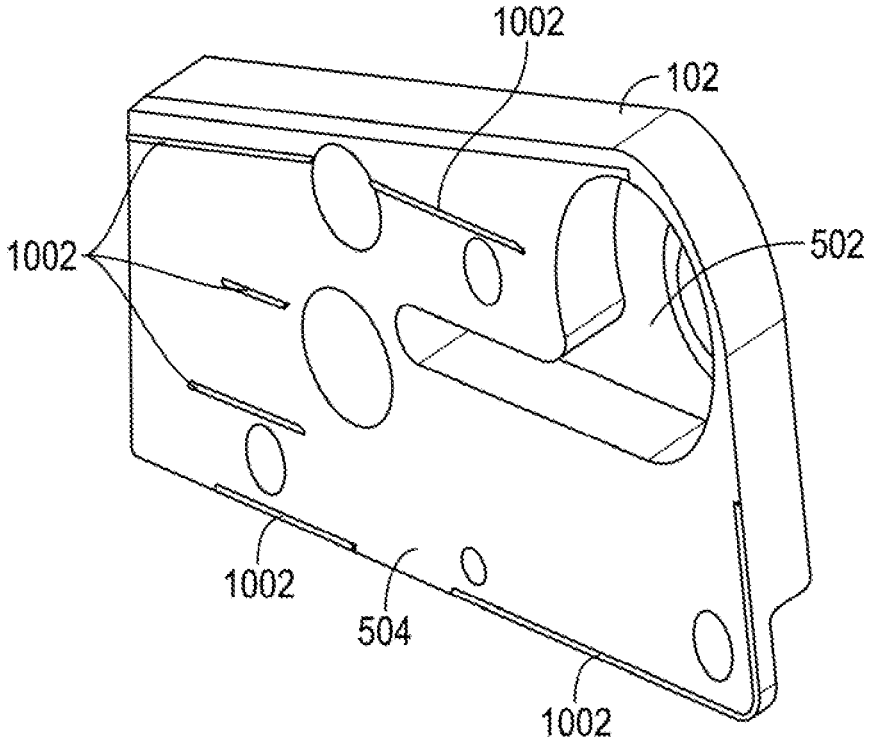
FIG. 10 representatively illustrates a perspective view of an alternative embodiment of an opposing housing plate to that shown in FIG. 9 in accordance with an exemplary embodiment of the present technology.

The interior surfaces of the first housing plate 102 and the second housing plate 104 may also be configured to create an enhanced seal. In one embodiment, the first housing plate 102, the upper cover portion 402, the lower trigger portion 406, and the lower spring portion 404 of the second housing plate 104 may comprise a beveled lip around their perimeters to create an enhanced seal. For example, and referring now to FIGS. 9 and 10, an outer edge of the interior surface of the first housing plate 102 may comprise a raised surface 1002 and the exterior edges of the upper cover portion 402, the lower trigger portion 406, and the lower spring portion 404 may comprise a recess or channel 902 configured to receive the raised surface on the first housing plate 102. The raised surface and the channel may make it more difficult for debris to pass into the interior of the trigger housing 101 and may also have the added benefit of helping lock the first housing plate 102 and the second housing plate 104 together during assembly.

Although the first housing plate 102 and the second housing plate 104 create a seal around much of the perimeter of the trigger housing 101, the openings at each location where a component extends outward from the interior of the trigger housing 101 may provide a location where debris could still enter the interior of the trigger housing 101. The trigger housing 101 may further comprise a sealing system configured to provide a seal around any protruding components to inhibit or prevent foreign debris from getting into the interior of the trigger housing 101. The sealing system may incorporate a plurality of sealing elements to create a seal around any component that protrudes outwardly from the trigger housing 101. The plurality of sealing elements may comprise any suitable material capable of providing a seal to prevent or otherwise limit debris from passing into the interior of the trigger housing 101 such as polymers, rubber, plastic, ceramic, metal, composites, or the like.

Figure 8:
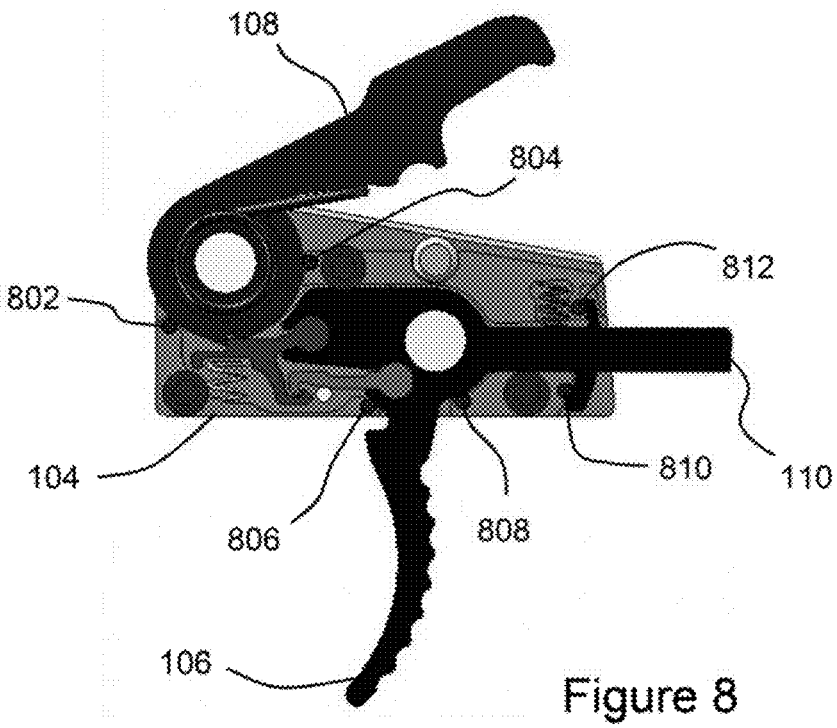
FIG. 8 representatively illustrates a side view of sealed trigger housing with a side plate removed in accordance with an exemplary embodiment of the present technology.

For example, and referring now to FIGS. 6 and 8, it is well understood that the hammer 108 rotates in both clockwise and counter-clockwise directions during the firing cycle. Because the hammer 108 rotates about a fixed location and protrudes outwardly from the trigger housing 101, the hammer opening 414 exists between the hammer 108 and the trigger housing 101 body otherwise rotation of the hammer 108 could be inhibited. To seal off the hammer opening 414, a first hammer seal 802 may be positioned in a first hammer seal recess 602 disposed along an upper edge of the lower trigger portion 404 and a second hammer seal 804 may be positioned in a second hammer seal recess 604 disposed along a forward edge of the upper cover portion 402, wherein the first and second hammer seals 802, 804 contact the hammer 108 when the trigger housing 101 is fully assembled.

Similarly, to seal off the trigger opening 410, a first trigger seal 806 may be positioned in a first trigger seal recess 606 disposed along a rear edge of the lower trigger portion 404 and a second trigger seal 808 may be positioned in a second trigger seal recess 608 disposed along a forward edge of the lower trigger portion 406, wherein the first and second trigger seals 806, 808 contact the trigger 106 when the trigger housing 101 is fully assembled.

In an embodiment having a selector opening 412, to seal off the selector opening 412, a first selector seal 810 may be positioned in a first selector seal recess 610 disposed along an upper edge of the lower trigger portion 404 and a second selector seal 812 may be positioned in a second selector seal recess 612 disposed along a lower edge of the upper cover portion 404, wherein the first and second selector seals 810, 812 contact the selector switch 110 when the trigger housing 101 is fully assembled.

The plurality of seals 802, 804, 806, 808, 810, 812 are configured to press against the protruding components to allow motion while reducing the ability of debris to enter the trigger housing 101 around these components. In one embodiment, each of the plurality of seals 802, 804, 806, 808, 810, 812 may comprise a rubberized pin that may be positioned in the plurality of recesses 602, 604, 606, 608, 610, 612. In an alternative embodiment, the plurality of seals 802, 804, 806, 808, 810, 812 may each comprise a stiff plastic pin.

These and other embodiments for methods of sealing an interior of a trigger housing may incorporate concepts, embodiments, and configurations as described above. The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present technology and are accordingly not limited to the specific configuration recited in the specific examples. Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises," "comprising," or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to an exemplary embodiment. However, changes and modifications may be made to the exemplary embodiment without departing from the scope of the present technology. These and other changes or modifications are intended to be included within the scope of the present technology, as expressed in the following claims.

The invention claimed is:

1. A trigger housing for one or more trigger mechanism components, comprising:

a first housing plate;

a second housing plate configured to be coupled to the first housing plate to form an interior volume to at least partially enclose the one or more trigger mechanism components, comprising:

an upper cover portion extending outward along an upper surface of the second housing plate and configured to abut an interior facing surface of the first housing plate and cover a top portion of a trigger when the first and second housing plates are coupled together;

a lower trigger portion positioned below the upper cover portion and extending outward along a lower rear surface of the second housing plate and configured to abut the interior facing surface of the first housing plate and cover a bottom portion of a trigger when the first and second housing plates are coupled together;

a lower spring portion positioned below the upper cover portion and extending outward along a lower forward surface of the second housing plate and configured to abut the interior facing surface of the first housing plate and cover a bottom portion of a hammer spring when the first and second housing plates are coupled together;

a trigger opening positioned between the lower trigger portion and the lower spring portion;

a hammer opening positioned between the upper cover portion and the lower spring portion;

a first hammer seal recess disposed along an upper edge of the lower spring portion;

a second hammer seal recess disposed along a forward edge of the upper cover portion a first trigger seal recess disposed along a rear edge of the lower spring portion; and a second trigger seal recess disposed along a forward edge of the lower trigger portion; and a plurality of sealing elements to:

create a seal between the trigger opening and a first trigger mechanism component protruding out of the trigger opening; and create a seal between the hammer opening and a second trigger mechanism component protruding out of the hammer opening.

2. A trigger housing according to claim 1, wherein the plurality of sealing elements comprises:

a first hammer seal positioned in the first hammer seal recess;

a second hammer seal positioned in the second hammer seal recess;

a first trigger seal positioned in the first trigger seal recess; and a second trigger seal positioned in the second trigger seal recess.

3. A trigger housing according to claim 1, wherein:

the second housing plate further comprises a selector opening positioned between the upper cover portion and the lower trigger portion; and the sealing elements are further configured to create a seal between the selector opening and a third trigger mechanism component protruding out of the selector opening.

4. A trigger housing according to claim 3, wherein:

the second housing plate further comprises:

a first selector seal recess disposed along an upper edge of the lower trigger portion; and a second selector seal recess disposed along a lower edge of the upper cover portion; and the sealing elements further comprise:

a first selector seal positioned in the first selector seal recess; and a second selector seal positioned in the second selector seal recess.

5. A trigger housing according to claim 1, wherein:

the first housing plate further comprises a first recess disposed along and extending into an interior facing surface configured to receive a first side portion of a hammer spring into the first recess when the first and second housing plates are coupled together; and the second housing plate further comprises a second recess disposed along and extending into an interior facing surface configured to receive a second side portion of the hammer spring into the second recess when the first and second housing plates are coupled together.

6. A trigger housing according to claim 1, wherein:

at least a portion of an outer edge of the interior surface of the first housing plate comprises a raised surface; and an exterior edge of the upper cover portion, the lower trigger portion, and the lower spring portion each comprise a channel configured to receive the raised surface on the first housing plate to form a seal between the abutting first and second housing plates.

7. A trigger housing for one or more trigger mechanism components, comprising:

a first housing plate;

a second housing plate configured to be coupled to the first housing plate to form an interior volume to at least partially enclose the one or more trigger mechanism components, and comprising:

a trigger opening positioned in a downward facing portion of the trigger housing;

a hammer opening positioned in a forward upper portion of the trigger housing;

a first hammer seal recess disposed along an upper edge of a lower spring portion extending outwardly from a lower forward interior surface of the second housing plate;

a second hammer seal recess disposed along a forward edge of an upper cover portion positioned above the lower spring portion and extending outwardly from an upper interior surface of the second housing plate;

a first trigger seal recess disposed along a rear edge of the lower spring portion; and a second trigger seal recess disposed along a forward edge of a lower trigger portion extending outwardly from a lower rear interior surface of the second housing plate; and a sealing system comprising:

a first trigger seal positioned in the first trigger seal recess;

a second trigger seal positioned in the second trigger seal recess, wherein the first and second trigger seals create a seal between the trigger opening and a first trigger mechanism component protruding out of the trigger opening;

a first hammer seal positioned in the first hammer seal recess; and a second hammer seal positioned in the second hammer seal recess, wherein the first and second hammer seals create a seal between the hammer opening and a second trigger mechanism component protruding out of the hammer opening.

8. A trigger housing according to claim 7, wherein:

the second housing plate further comprises a selector opening positioned in a rear facing portion of the trigger housing; and the sealing system is further configured to create a seal between the selector opening and a third trigger mechanism component protruding out of the selector opening.

9. A trigger housing according to claim 8, wherein:

the second housing plate further comprises:

a first selector seal recess disposed along an upper edge of a lower surface of the selector opening; and a second selector seal recess disposed along a lower edge of an upper surface of the selector opening; and the sealing system further comprises:

a first selector seal positioned in the first selector seal recess; and a second selector seal positioned in the second selector seal recess.

10. A trigger housing according to claim 7, wherein:

the first housing plate further comprises a first recess extending into a forward interior surface configured to receive a first side portion of a hammer spring into the first recess when the first and second housing plates are coupled together; and the second housing plate further comprises a second recesses extending into the forward interior surface configured to receive a second side portion of the hammer spring into the second recess when the first and second housing plates are coupled together.

11. A trigger housing according to claim 7, wherein:

at least a portion of an outer edge of the interior surface of the first housing plate comprises a raised surface; and an exterior edge of an upper cover portion, a lower trigger portion, and a lower spring portion each comprise a channel configured to receive the raised surface on the first housing plate to form a seal between the abutting first and second housing plates.

* * * * *